US005289902A

United States Patent [19]

Fujita

[11] Patent Number: 5,289,902

[45] Date of Patent: Mar. 1, 1994

[54] ELEVATOR

[75] Inventor: Yoshiaki Fujita, Tokyo, Japan

[73] Assignee: Kabushiki Kaisha Toshiba, Kawasaki, Japan

[21] Appl. No.: 966,394

[22] Filed: Oct. 26, 1992

[30] Foreign Application Priority Data

| | | | |
|---|---|---|---|
| Oct. 29, 1991 | [JP] | Japan | 3-282876 |
| Oct. 31, 1991 | [JP] | Japan | 3-286374 |
| Mar. 9, 1992 | [JP] | Japan | 4-050084 |

[51] Int. Cl.[5] ..... B66B 7/04

[52] U.S. Cl. ..... 187/95; 187/1 R

[58] Field of Search ..... 187/1 R, 95

[56] References Cited

U.S. PATENT DOCUMENTS

| | | | |
|---|---|---|---|
| 1,854,976 | 4/1932 | Brady | 187/95 |
| 2,253,820 | 8/1941 | Spiro | 187/95 |
| 2,260,922 | 10/1941 | Spiro | 187/95 |
| 2,265,086 | 12/1941 | Spiro | 187/95 |
| 3,087,583 | 4/1963 | Bruns | 187/95 |
| 3,099,334 | 7/1963 | Tucker | 187/95 |
| 3,669,222 | 6/1972 | Takamura et al. | 187/95 |
| 4,754,849 | 7/1988 | Ando | 187/95 |
| 5,086,882 | 2/1992 | Sugahara et al. | 187/95 |

FOREIGN PATENT DOCUMENTS

| | | |
|---|---|---|
| 0033184 | 8/1981 | European Pat. Off. . |
| 1-197294 | 8/1989 | Japan . |

*Primary Examiner*—Robert P. Olszewski
*Assistant Examiner*—Dean A. Reichard
*Attorney, Agent, or Firm*—Foley & Lardner

[57] ABSTRACT

An elevator having a cage disposed inside guide rails, a damper unit, a vibration sensor, and a control circuit. The damper unit is controlled by the control circuit in response to vibrations of the cage which are detected by the vibration sensor. The vibration sensor detects the vibration of the cage, converts the vibration into an electric signal, and transmits the electric signal to the control circuit. The control circuit compares the electric signal with a predetermined value and controls the coefficient of viscous damping of the damper unit according to the result of the comparison. Accordingly, vibrations of the cage are absorbed and reduced, and the elevator provides a more comfortable ride.

13 Claims, 15 Drawing Sheets

ELEVATOR

BACKGROUND OF THE INVENTION

1. Field of the Invention

This invention relates to an elevator which has a rising and falling cage connected by a cable of a traction machine. In particular, this invention relates to an elevator having control mechanisms for controlling the vibration of the cage.

2. Background

As shown in FIGS. 24 through 26, each of parallel guide rails 3 is disposed vertically on a rising and falling path 2. The vertical path 2 forms an elevator shaft in a building 1, and is further defined by a plurality of brackets 4 which typically represent the respective floors of building 1. Cage 5 rises and falls by a main cable 6 which is connected to a traction machine (not shown). Cage 5 is disposed within guide rails 3. As shown in FIG. 24, cage 5 consists of cage frame 5*a* and cage room 5*b*, and vibration-damping materials 7*a*, 7*b* are disposed between cage frame 5*a* and cage room 5*b*.

As shown in FIG. 25, supporting units 8 are disposed at each of the upper and lower corners of cage frame 5*a*, and approximately T-shaped operating levers 9 are pivoted to the supporting units 8 by pin-axles 9*a*. Guide rollers 10 are disposed to touch guide rails 3 and are connected to supporting unit 8 in the middle section of operating levers 9 through supporting axles 11.

Oil damper units 12, such as hydraulic cylinder units, are connected to one end portion of operating lever 9 by pin-axle 13 and are disposed on the cage 5. Guide levers 14, 15 pass through the upper section 9*b* of operating lever 9 and guide levers 14, 15 are disposed in an upper section of the supporting unit 8, and are parallel to each other. Nut Na prevents an adjusting spring 16 from coming off the end of guide lever 14. Guide roller 10 is pressed toward the guide rail 3 by adjusting spring 16. Nut Nb prevents a stopper 17 from coming off the end of guide lever 15, and stopper 17 restricts the range of movement of operating lever 9.

Guide rails 3 are originally constructed of steel or other metals or alloys thereof, and form a planar surface with guide roller 10. However, over prolonged use, guide rails 3 become worn particularly in the areas between respective floors. Thus, guide rails 3 form undulations in the form of windings as shown in FIG. 26.

When guide rails 3 have windings as shown in FIG. 26, operating levers 9 are displaced in response to buffers of the oil damper unit 12 and the adjusting spring 16. Vibration of cage 5, which occurs in response to the windings of the guide rails 3, is controlled due to the degree of displacement of the operating levers 9 permitted by damper unit 12 and adjusting spring 16.

When the distribution of load in cage 5 is inclined, namely, when cage 5 tilts, operating lever 9 touches the stopper 17 and cage 5 is prevented from tilting more than a predetermined value. Generally, the load in cage 5 is distributed evenly, and cage 5 is maintained in the level state. When the vibrations caused by the windings of the guide rails 3 are controlled by oil damper unit 12 and adjusting spring 16, external forces transmitted to cage 5 from guide rails 3 through guide rollers 10 are decreased. Accordingly, it is preferable that the spring constant of adjusting spring 16 and the coefficient of viscous damping of oil damper unit 12 are set at a lower level.

However, in the elevator as described above, when the spring constant of adjusting spring 16 is set at a lower level, operating lever 9 touches the stopper 17 at a comparatively small inclined load. Moreover, when cage 5 rises and falls at high speed, cage 5 is necessarily displaced by the windings of the guide rails 3. As a result, cage 5 rolls heavily.

As shown in FIG. 26, the wavelength of the winding of the guide rail 3 almost corresponds with each interval of the brackets 4. The interval of the brackets 4 is typically about 3 meters to about 5 meters, and the interval corresponds to the interval of floors in building 1. When cage 5 rises and falls along guide rails 3 at high speed, i.e., more than about 360 m/min, cage 5 is excited at about 2 to about 4 Hz of amplitude horizontally. When the excited frequency which occurs at the time that cage 5 passes through each of brackets 4 at high speed corresponds with the primary natural frequency of cage 5, (the primary natural frequency in the horizontal direction of cage 5 exists in the range of about 2 to about 4 Hz), the cage resonates. As a result, cage 5 rolls heavily.

It is effective to increase the coefficient of viscous damping of the oil damper unit 12 in order to reduce the amplitude of this resonance. However, this reduces the buffer of adjusting spring 16 against the excited force generated by the small windings of the guide rails 3. As a result, it becomes uncomfortable to ride in cage 5, and it is difficult to effectively prevent cage 5 from vibrating.

SUMMARY OF THE INVENTION

It is an object of this invention to provide an elevator having a cage which is comfortable to ride in, and which is capable of absorbing vibrations generated by elevator rolling.

In order to achieve this object and other objects readily apparent to those skilled in the art, there is provided an elevator which has a damper mechanism for absorbing vibrations of the cage, a detecting mechanism for detecting the vibrations of the cage, and a control mechanism for controlling the coefficient of viscous damping of the damper mechanism in response to a signal from the detecting mechanism.

DETAILED DESCRIPTION OF THE PREFERRED EMBODIMENTS

Figure 1:
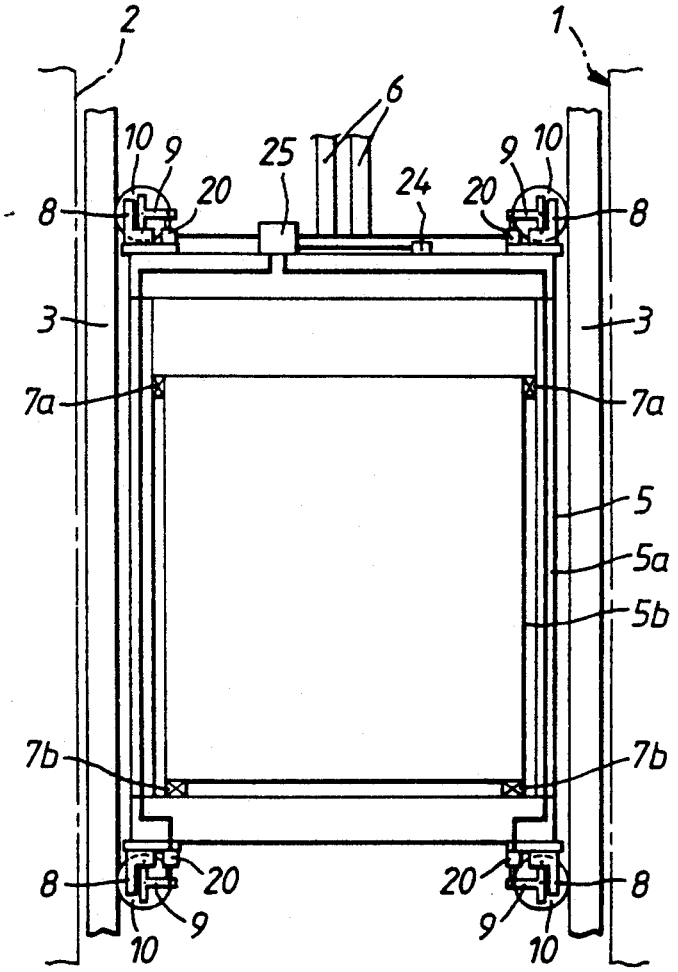
FIG. 1 is a front view illustrating a first embodiment of the invention.

A first embodiment of the invention will be described in detail with reference to FIGS. 1-5. In this embodiment, elements similar to the prior art are given similar reference numerals.

Figure 2:
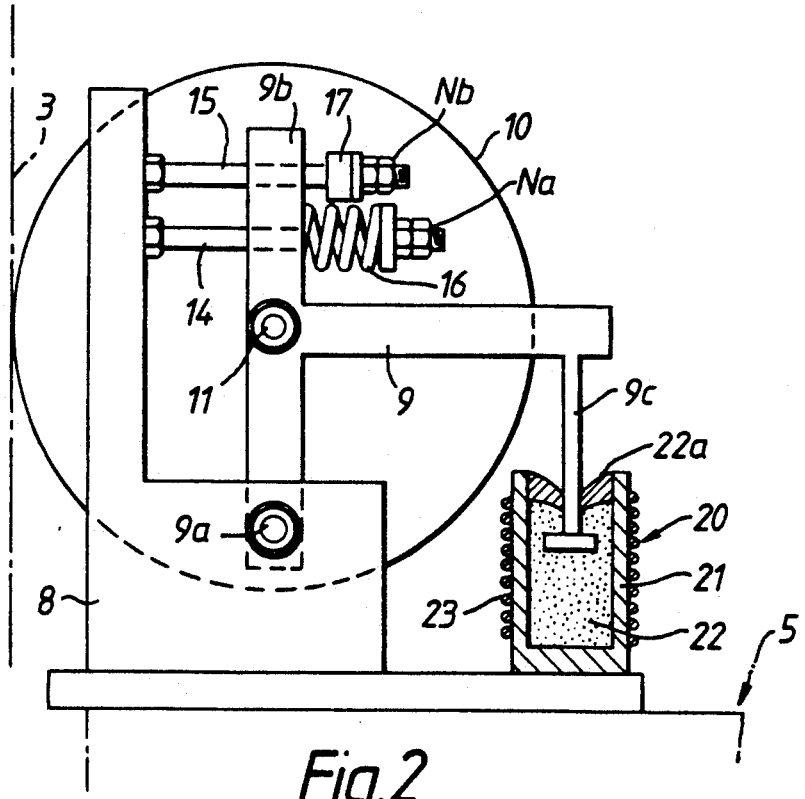
FIG. 2 is an enlarged sectional view illustrating a detailed part of the first embodiment of the invention.
Figure 3:
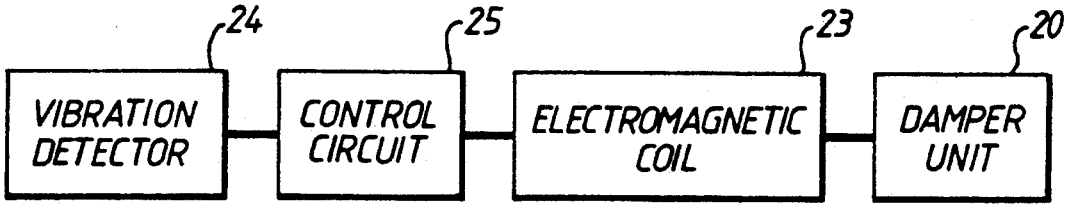
FIG. 3 is a block schematic diagram illustrating the first embodiment of the invention.

Referring to FIGS. 1 through 3, a rising and falling path 2 is formed vertically in a high-rise building 1, and each of guide rails 3 is disposed vertically parallel along the rising and falling path 2 through a plurality of brackets 4.

A cage 5 is disposed inside guide rails 3 and rises and falls by a main cable 6 connected to a traction machine (not shown). The cage 5 consists of cage frame 5*a* and cage room 5*b*, and vibration-proof materials 7*a* and 7*b* are disposed between cage frame 5*a* and cage room 5*b*.

As shown in FIG. 2, supporting units 8 are disposed at each of the upper and lower corners of cage frame 5*a*, and approximately T-shaped operating levers 9 are pivoted to the supporting units 8 by pin-axles 9*a*. Guide rollers 10 are disposed to touch guide rails 3 and are connected to supporting unit 8 in the middle section of operating levers 9 through supporting-axles 11. Further, damper units 20 filled with magnetic fluid are connected to one end part of the operating levers 9 and are disposed on the cage 5.

Damper unit 20 has a cylinder 21 made from a non-magnetic material and filled with magnetic fluid 22. An electromagnetic coil 23 is wound around cylinder 21 in order to provide a mechanism to control the viscosity of magnetic fluid 22, and a piston-formed link 9*c* is soaked into magnetic fluid 22. A sealing material 22*a*, preferably made from rubber, covers the opening formed in the upper portion of cylinder 21 in order to prevent magnetic fluid 22 from leaking. Sealing material 22*a* also is provided with a small opening to permit movement of piston-formed or piston-shaped link 9*c*. A vibration sensor 24, such as, for example, an accelerometer, is capable of detecting the vibrations from cage 5, and is connected to electromagnetic coil 23 through a control circuit 25.

Guide levers 14, 15 pass through the upper section 9*b* of operating lever 9, and guide levers 14, 15 are disposed in the upper section of the supporting unit 8, and are parallel to each other. Nut Na prevents an adjusting spring 16, such as a coil spring, from coming off the end of guide lever 14. Guide roller 10 is pressed toward the guide rail 3 by adjusting spring 16. Nut Nb prevents stopper 17 from coming off the end of guide lever 15, and stopper 17 restricts the range of movement of operating lever 9.

Figure 4:
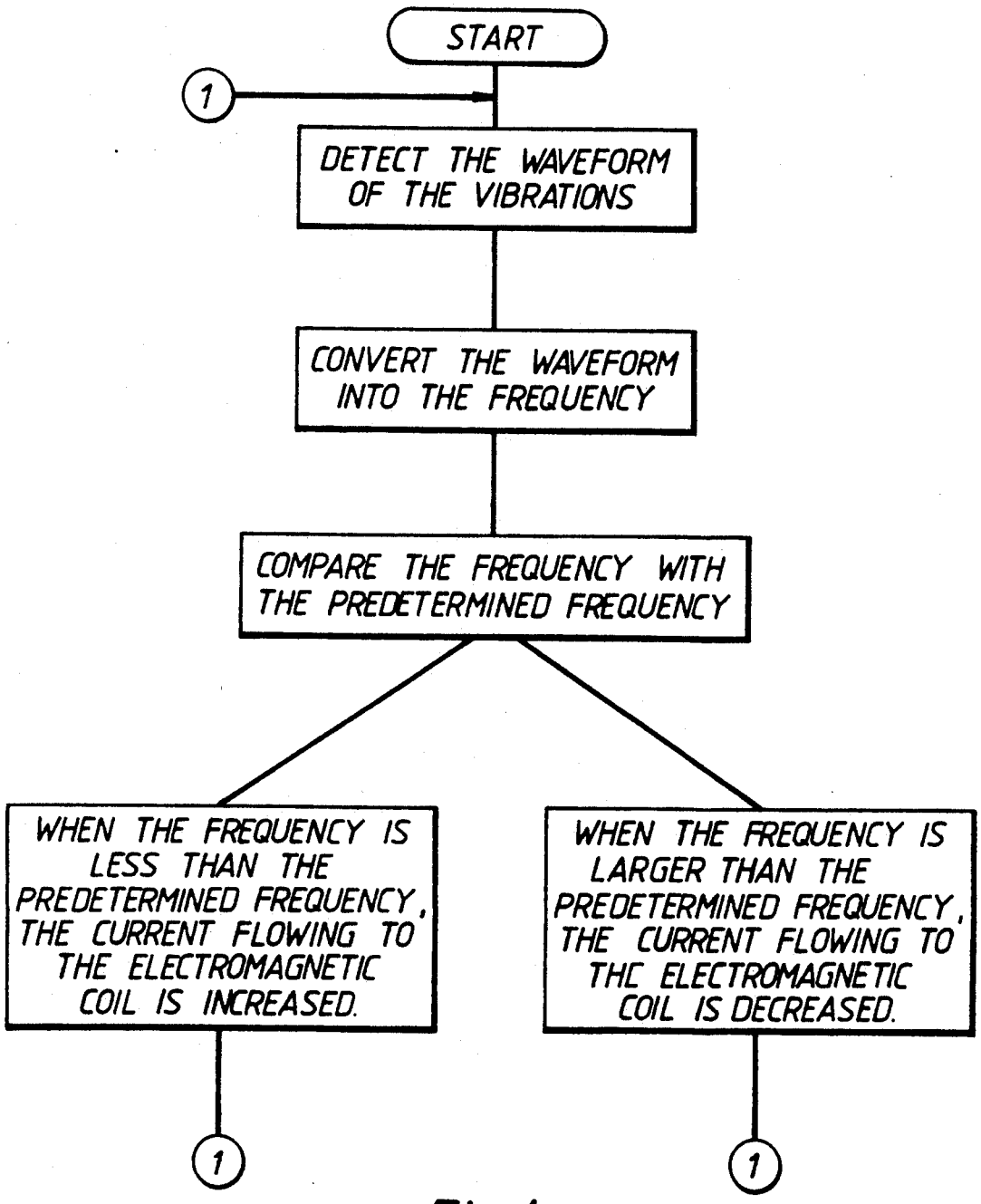
FIG. 4 is a flow chart illustrating the action of the first embodiment of the invention.

The operation of the first embodiment will now be described in more detail with reference to FIG. 4. The vibration sensor detects the vibrations of cage 5, converts the vibration into an electric signal and transmits the electric signal to control circuit 25. Control circuit 25 compares the electric signal of the detected vibrations of cage 5 with a predetermined value, for example, 10 Hz. This predetermined value typically is a value which represents the optimal amount of vibration permitted by cage 5. Persons having ordinary skill in the art recognize that this predetermined value will vary depending on the design of the elevator.

When the electric signal is smaller than the predetermined value, the current flowing to electromagnetic coil 23 is increased by control circuit 25 and thereby increases the viscosity of magnetic fluid 22 in response to the increased current. On the other hand, when the electric signal is larger than the predetermined value, the current is decreased or turned off by control circuit 25 thereby decreasing the viscosity in response to the decreased current. Accordingly, when the electrical signal of the detected vibrations is smaller than the predetermined value, the coefficient of viscous damping of magnetic fluid 22 in damper unit 20 increases because of the increase of the viscosity, and the damping force further limits the movement of operating lever 9. On the other hand, when the electrical signal of the detected vibration is larger than the predetermined value, the coefficient of viscous damping of magnetic fluid 22 decreases because of the decrease of the viscosity, and the decreased damping force increases the freedom of movement of operating lever 9. Furthermore, because there is no friction force generated between piston-shaped link 9*c* and cylinder 21, damper unit 20 generates a minute damping force in response to the velocity of the movement of piston-shaped link 9*c* against the minute movement of operating lever 9.

The damping force generated in damper unit 20 acts not to reduce the buffer of adjusting spring 16. Throughout the specification and claims, the term "buffer" defines the amount of relative rotative movement of operating lever 9 and piston-shaped link 9*c* permitted by adjusting spring 16 and/or damping unit 20. Therefore, operating lever 9 displaces in response to the buffers of both damper unit 20 and adjusting spring 16, and does not touch stopper 17. Accordingly, the vibration of cage 5 which occurs in response to the windings of the guide rails 3 is effectively controlled.

In the embodiment described above, when cage 5 vibrates or rolls in response to the resonance generated by the excitement which is caused by the windings of guide rails 3, the vibrations of cage 5 are controlled. Therefore, the amplitude of the resonance is not increased; rather the amplitude is decreased as movement of operation lever 9 is decreased due to an increase of the damping force of damper unit 20. Further, when the vibrations of cage 5 are larger than the predetermined value, the damping force of damper unit 20 becomes very small, thereby permitting greater movement of operating lever 9 and absorption of the larger vibrations. Accordingly, small windings and recesses, or undulations, formed on guide rails 3 are absorbed by adjusting spring 16, and the vibrations are not transmitted to cage 5.

Figure 5:
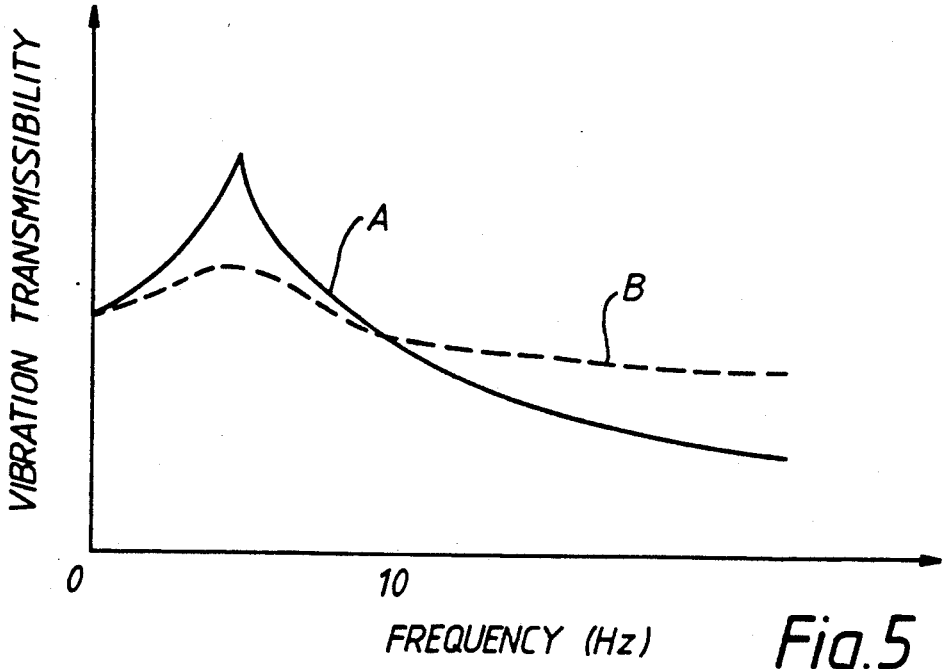
FIG. 5 is a graph illustrating the relationship between the frequency of the cage and the vibration transmissibility of the cage of the first embodiment of the invention.

In this embodiment, the vibration transmissibility generated in accordance with the control of the present invention preferably corresponds to the lower of the two curves shown in FIG. 5 at each frequency. In FIG. 5, solid line A indicates a change of the vibration transmissibility in the case where the damping force is smaller, and dotted line B indicates a change of the vibration transmissibility in the case where the damping force is larger. Thus, it can be seen that when the detected frequency is greater than the predetermined frequency, the vibration transmissibility follows solid line A, and when the detected frequency is less than the predetermined frequency, the vibration transmissibility follows dotted line B. Accordingly, the vibration due to the rolling of cage 5 can be greatly reduced and elevators which have damping units of the present invention offer a more comfortable ride.

Because this embodiment controls the coefficient of viscous damping in order to improve the absorption of the vibration of cage 5, it is comfortable to ride in. Additionally, as damper unit 20 does not have rubbing parts, friction forces are not produced, and the buffer of adjusting spring 16 is not reduced by minute vibrations.

Figure 6:
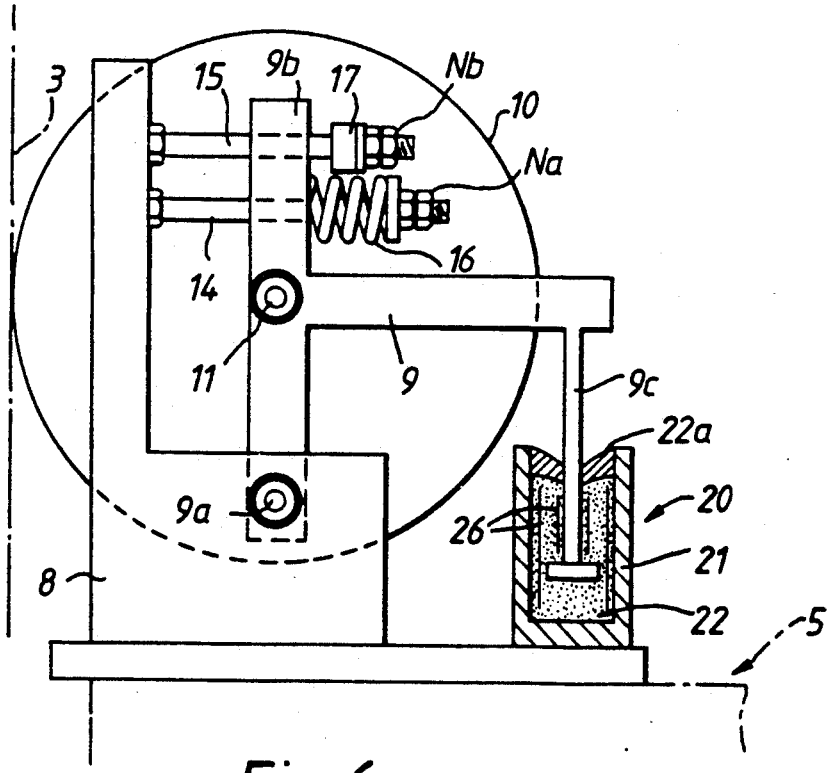
FIG. 6 is an enlarged sectional view illustrating a second embodiment of the invention.

A second embodiment of the invention will be described in detail with reference to FIG. 6. Electrodes 26 are used instead of electromagnetic coils 23, and are disposed concentrically in cylinder 21 of damper unit 20. Potential differences between electrodes 26 are controlled by vibration sensor 24 and control circuit 25. As a result, the viscosity of the magnetic fluid 22 is controlled by increasing or decreasing the current to electrodes 26 in the same manner as described above with reference to the first embodiment.

Figure 7:
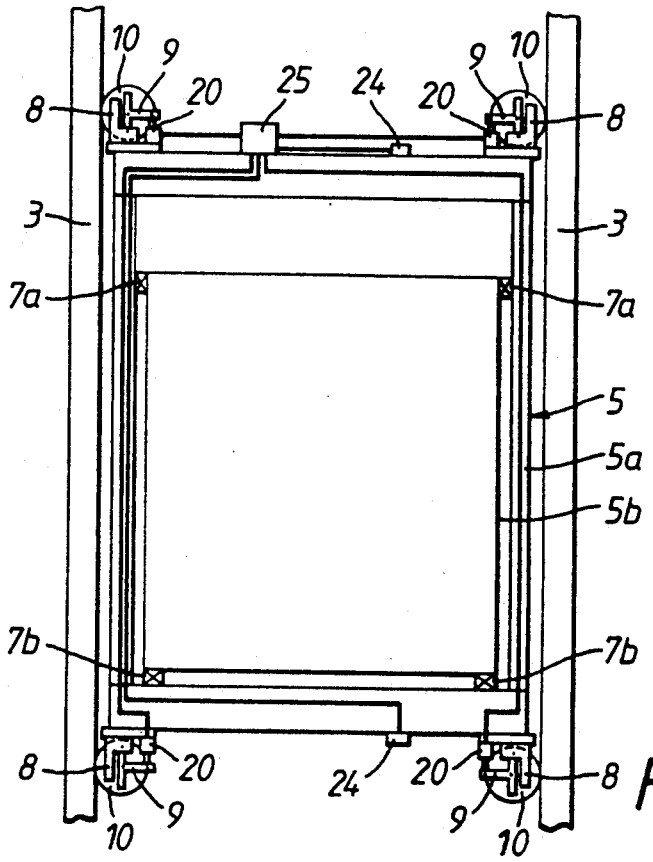
FIG. 7 is a front view illustrating a third embodiment of the invention.

In a third embodiment, as shown in FIG. 7, vibration sensors 24 are disposed at the upper cage frame 5*a* of cage 5 and the lower cage frame 5*a* of cage 5. In this embodiment, vibrations generated at each of the upper and lower cage frames 5*a* of cage 5 are detected.

Figure 8:
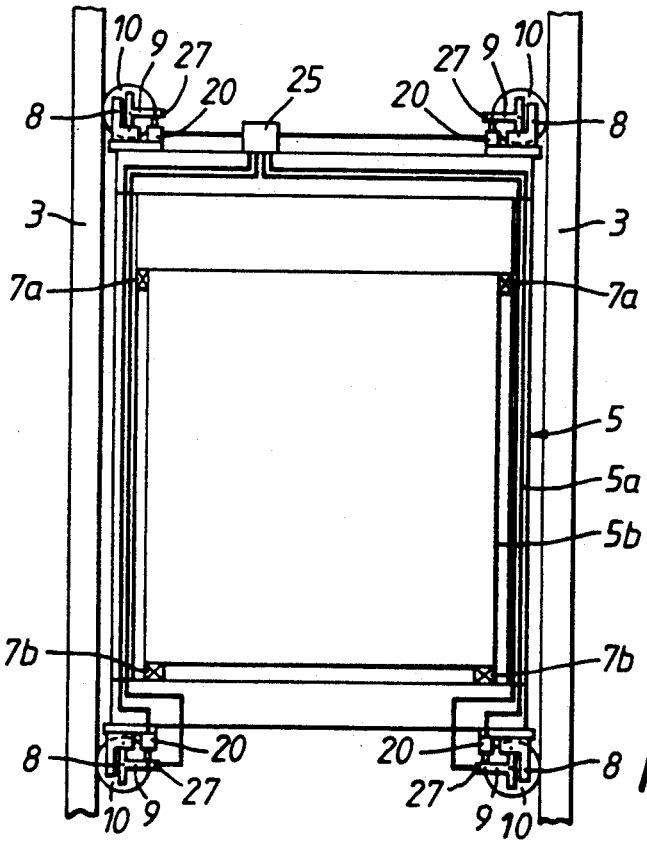
FIG. 8 is a front view illustrating a fourth embodiment of the invention.
Figure 9:
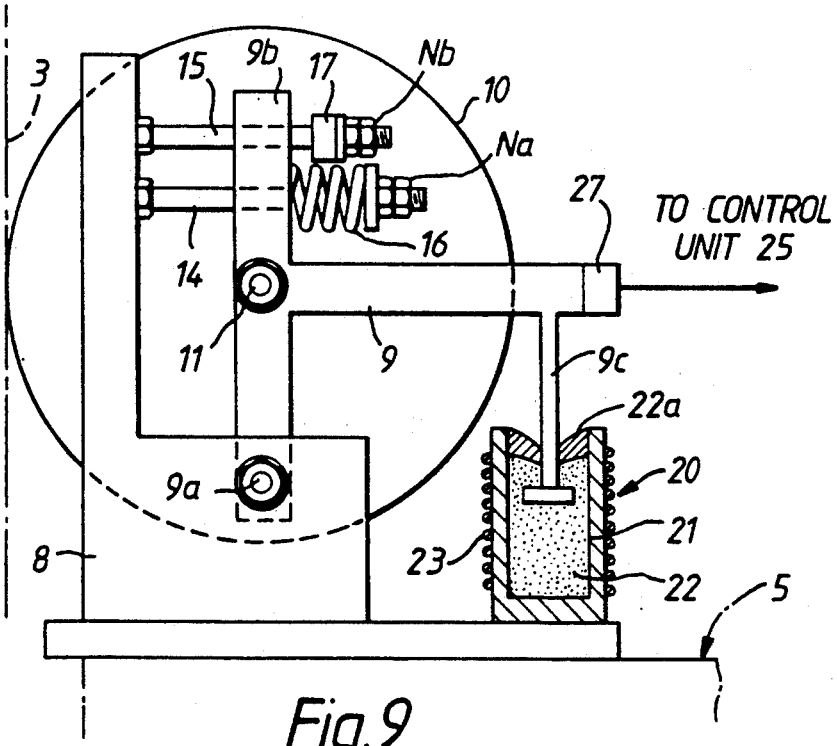
FIG. 9 is an enlarged sectional view illustrating a fourth embodiment of the invention.
Figure 10:
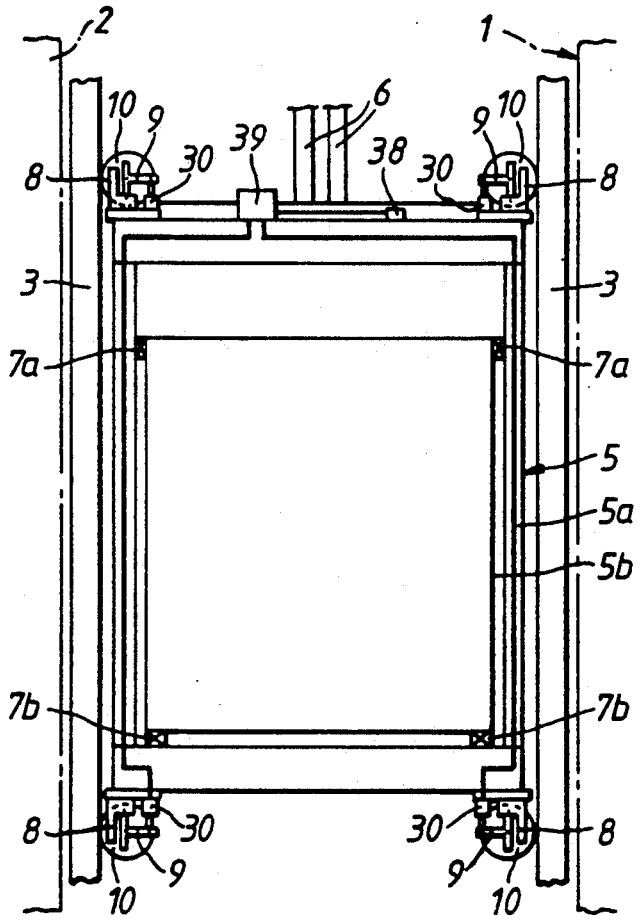
FIG. 10 is a front view illustrating a fifth embodiment of the invention.
Figure 11:
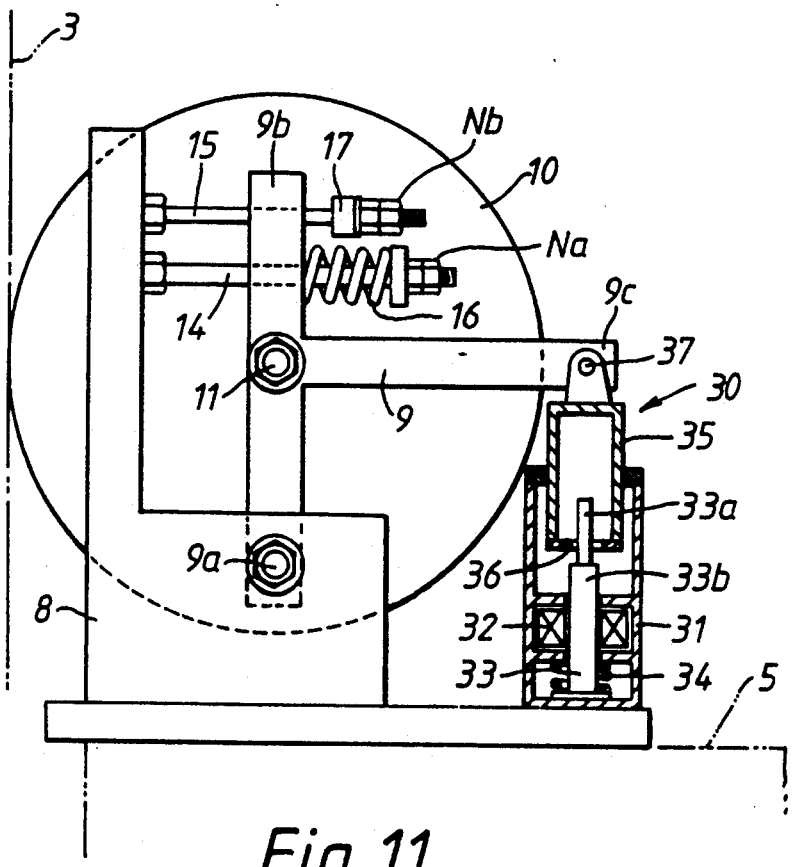
FIG. 11 is an enlarged sectional view illustrating a detailed part of the fifth embodiment of the invention.
Figure 12:
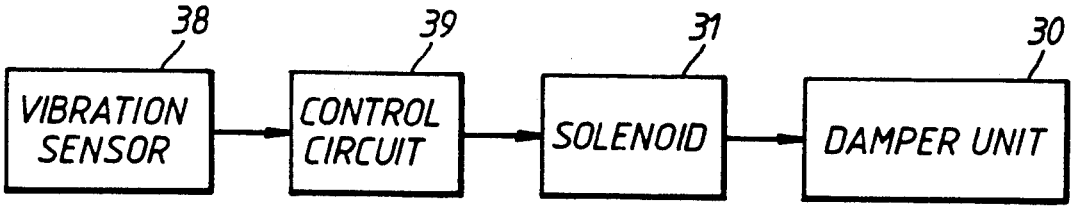
FIG. 12 is a block schematic diagram illustrating the fifth embodiment of the invention.

In a fourth embodiment, as shown in FIGS. 8 and 9, vibration sensors 27 (such as accelerometers) are disposed each at the ends of operating levers 9 to detect each of the windings of guide rails 3. In this embodiment, the vibrations of cage 5 are detected with even greater precision.

A fifth embodiment of the invention will be described in detail with reference to FIGS. 10–14. In this embodiment, similar elements are given similar reference numerals. A rising and falling path 2 is formed vertically in a building 1 and each of guide rails 3 is disposed vertically parallel along rising and falling path 2 through a plurality of parallel brackets 4.

Cage 5 is disposed inside guide rails 3, and rises and falls by a main cable 6 connected to a traction machine (not shown). Cage 5 consists of cage frame 5*a* and cage room 5*b*, and vibration-proof materials 7*a*, 7*b* are disposed between cage frame 5*a* and cage room 5*b*.

Supporting units 8 are disposed at each part of upper and lower corners of cage frame 5*a* and cage room 5*b*. Supporting units 8 are disposed at each section of upper and lower corners of cage frame 5*a*, and generally T-shaped operating levers 9, are pivotally connected to supporting units 8 by pin-axles 9*a*. Guide rollers 10 are disposed to touch guide rails 3 and are connected to supporting unit 8 in the middle section of operating levers 9 through supporting-axles 11. Further, damper units 30, such as an electromagnetic coil, are connected to one end of operating levers 9 and are disposed on the cage 5.

Damper unit 30 typically comprises a solenoid 31, and a cylindrical electromagnetic coil 32 disposed in the solenoid 31. An orifice lever 33 having a thin part 33*a* and a thick part 33*b* is suspended in electromagnetic coil 32 by a coil spring 34, and can be risen against coil spring 34 by electromagnetic coil 32. An orifice 36 of plunger 35 is fit into solenoid 31 so that the thin part 33*a* and the thick part 33*b* of orifice lever 33 are vertically movable in plunger 35. An upper section of plunger 35 is pivoted at the one end section 9*c* of operating lever 9 by a pin-axle 37. Further, a vibration sensor 38, such as an accelerometer and the like, which is capable of detecting the vibrations of cage 5, is connected to electromagnetic coil 32 through a control circuit 39.

On one hand, a pair of guide levers 14, 15 pass through an upper section 9*b* of operating lever 9, and are disposed in an upper section of supporting unit 8 parallel to each other. Nut Na prevents an adjusting spring 16 from coming off an end of guide lever 14. Guide roller 10 is pressed toward guide rail 3 by adjusting spring 16. Nut Nb prevents stopper 17 from coming off an end of guide lever 15, and stopper 17 restricts the range of movement of operating lever 9.

Figure 13:
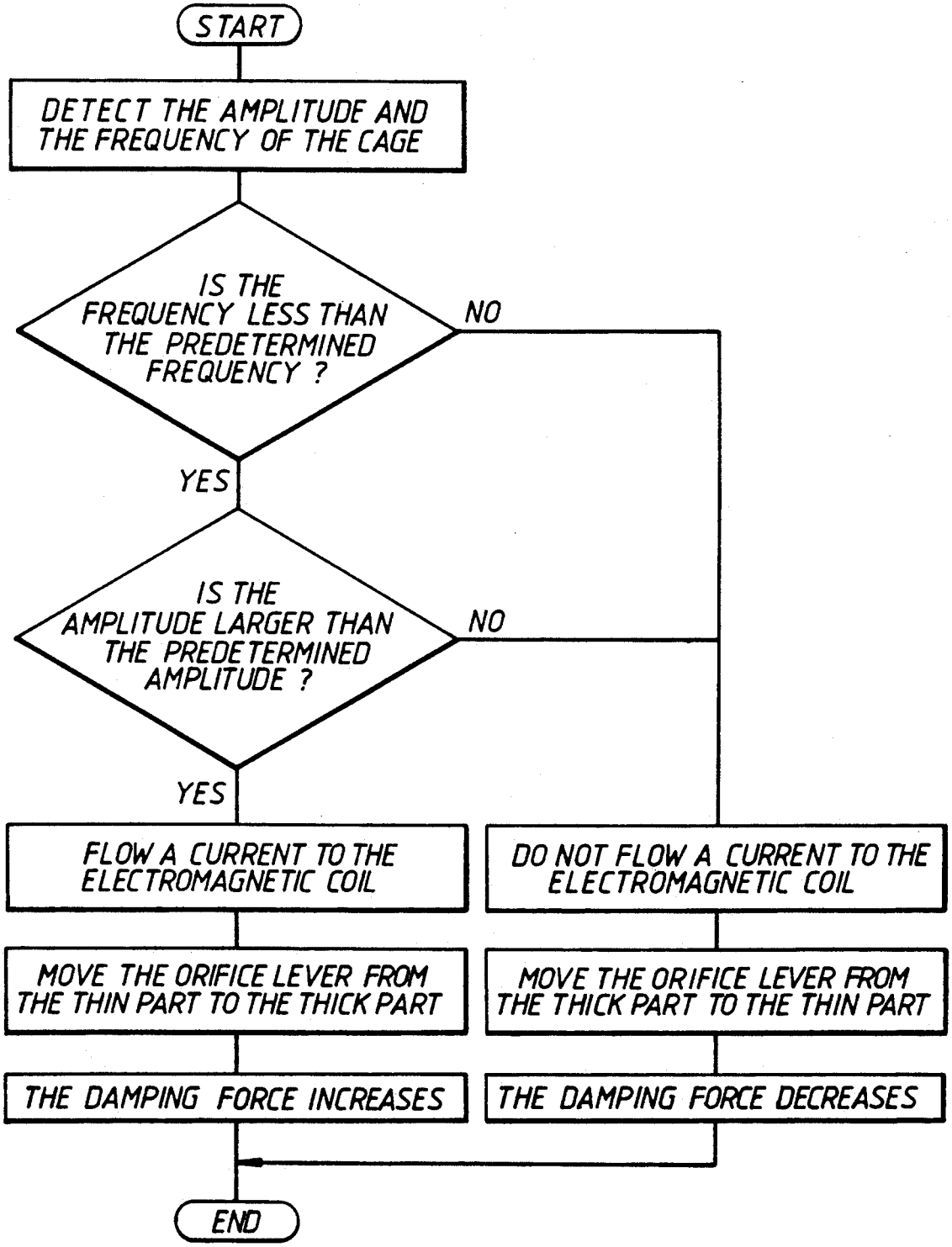
FIG. 13 is a flow chart illustrating the action of the fifth embodiment of the invention.

Referring now to FIG. 13, in this embodiment, when cage 5 rises and falls, vibration sensors 38 disposed on cage 5 detect the amplitude and the frequency of the vibration of cage 5, and transmit the detected amplitude and the detected frequency to control circuit 39. Control circuit 39 compares the vibrations and the frequency with each of the predetermined data. When the frequency is smaller than the predetermined frequency, (for example, 10 Hz), and the amplitude is larger than the predetermined amplitude, (for example, 10 gal), control circuit 39 directs the flow of current to electromagnetic coil 32. When current is directed to electromagnetic coil 32, orifice lever 33 passes through orifice 36 of plunger 35 as it rises. Thus, the part passing through orifice 36 of the lever 33 changes from thin part 33*a* to thick part 33*b*. The gap between orifice 36 and orifice lever 33 therefore becomes narrower, and the damping force of damper unit 30 increases.

On the other hand, when the frequency is more than the predetermined frequency (for example, 10 Hz), or the amplitude is less than the predetermined amplitude (for example, 10 gal), control circuit 39 diverts or impedes the flow of direct current from electromagnetic coil 32. Accordingly, orifice lever 33 falls, and the part passing through orifice 36 changes from thick part 33*b* to thin part 33*a*. As a result, the gap between orifice 36 and orifice lever 33 becomes wider, and the damping force of the damping unit 30 decreases.

When the detected frequency is smaller than the predetermined frequency, and the detected amplitude is larger than the predetermined amplitude, the damping force of damper unit 30 is increased, and the vibrations of cage 5 are reduced. When the detected frequency is greater than the predetermined frequency, or the detected amplitude is less than the predetermined amplitude, the damping force of damper unit 30 is decreased. When the detected amplitude of cage 5 is less than the predetermined value, and the detected frequency is more than the predetermined value, the damping force of damper unit 30 greatly decreases. The damping force generated in damper unit 30 acts not to reduce the buffer of adjusting spring 16, and the vibrations due to rolling of cage 5 are absorbed and reduced in order to provide a more comfortable ride. Accordingly, small windings and recesses, or undulations, formed on the guide rails 3 are absorbed by adjusting spring 16, and the vibrations are not transmitted to cage 5. The damping force of damper unit 30 is thereby controlled to minimize the vibrations of cage 5 in response to the amplitude and the frequency of cage 5.

As described above, when cage 5 rolls in response to the resonance generated by the excitement which is caused by the windings of guide rails 3, the vibrations of cage 5 are controlled so as not to increase the amplitude of the resonance as the movement of operating lever 9 is increased. Control of the vibrations of cage 5 is effected primarily by controlling the damping force of damper unit 30. As a result, the occurrence of rolling of cage 5 is remarkably reduced, and elevators made in accordance with the present invention provide a more comfortable ride.

Figure 14:
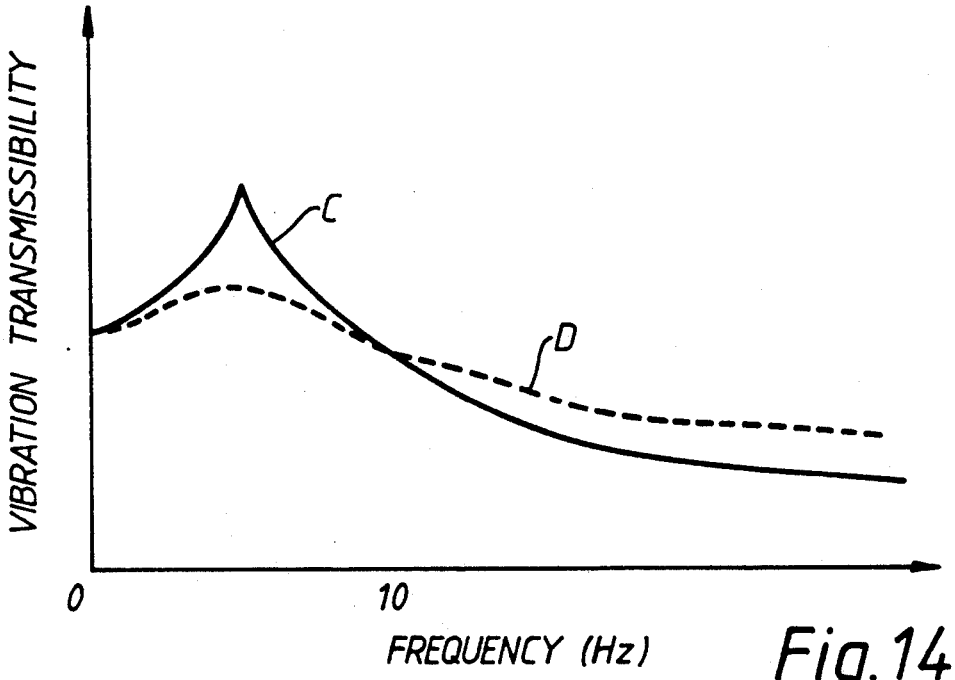
FIG. 14 is a graph illustrating the relationship between the frequency of the cage and the vibration transmissibility from a guide rail to a cage of the fifth embodiment of the invention.

The graph shown in FIG. 14 illustrates the relationship between the frequency of cage 5 and the vibration transmissibility from guide rails 3 to cage 5. In FIG. 14, solid line C indicates a change of the vibration transmissibility in the case where the damping force is small, and dotted line D indicates a change of the vibration transmissibility in the case where the damping force is large. The vibration transmissibility generated in accordance with the control of the present invention corresponds to the lower of the two lines shown in FIG. 14 at every frequency. Thus, the damping force of damper unit 30 is controlled to minimize the vibration of cage 5 in order to make cage 5 more comfortable.

Figure 15:
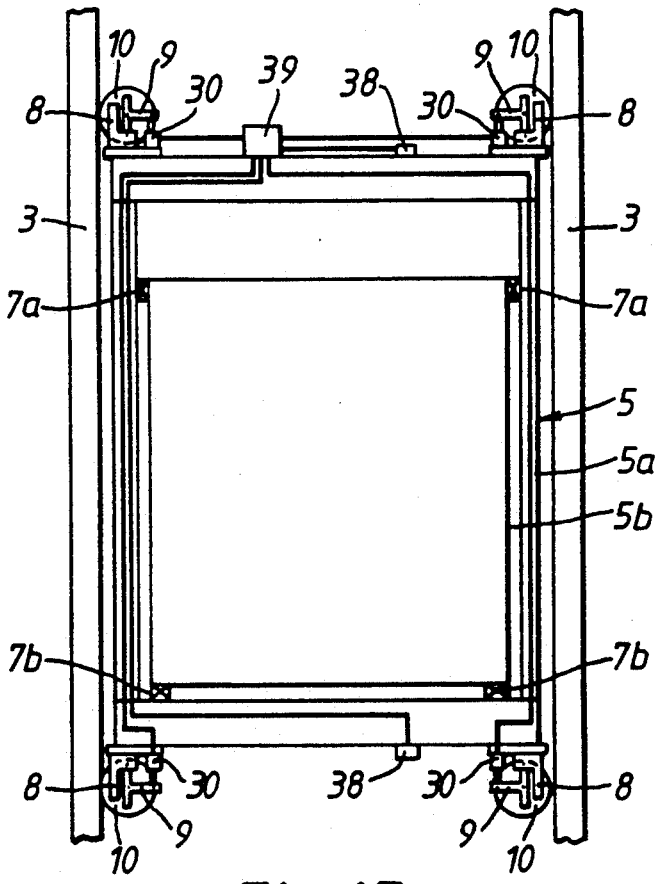
FIG. 15 is a front view illustrating a sixth embodiment of the invention.

In a sixth embodiment, shown in FIG. 15, vibration sensors 38 are disposed at the upper cage frame 5*a* of cage 5 and the lower cage frame 5*a* of cage 5. In this embodiment, vibrations generated at each of the upper and lower cage frames 5*a* of cage 5 are detected.

Figure 16:
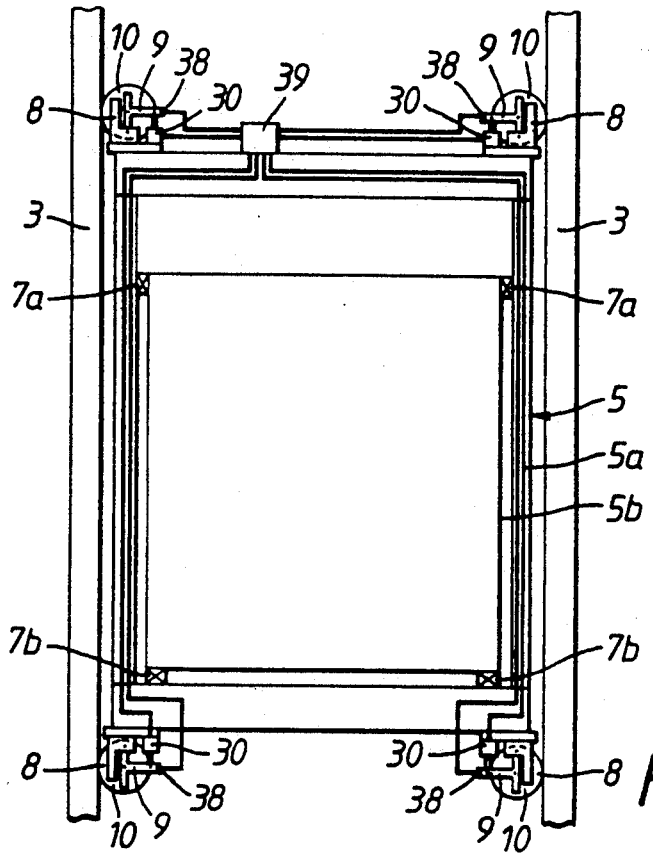
FIG. 16 is a front view illustrating a seventh embodiment of the invention.

In a seventh embodiment, shown in FIG. 16, vibration sensors 38 (such as accelerometers) are disposed each at the ends of operating levers 9 and detect the windings of guide rails 3 directly. In this embodiment, the vibrations of cage 5 are detected with even greater precision.

As described above in accordance with the fifth embodiment through the seventh embodiment, operating levers 9 are pivoted to cage 5 which rises and falls along guide rails 3, and guide rollers 10 are pivoted to operating levers 9 to touch guide rails 3. Damper units 30 are connected to part of operating levers 9 and are disposed on the cage 5. The electromagnetic coils 32 are disposed in the solenoids 31 of the damper units 30. Each of orifice levers 33 having a thin part 33*a* and a thick part 33*b* is suspended in electromagnetic coil 32 by coil spring 34, and is capable of being risen against coil spring 34 by electromagnetic coil 32. Thin part 33*a* and thick part 33*b* are vertically movable in plunger 35 relatively, and plunger 35 is connected to operating lever 9.

In accordance with these embodiments, direct current is controlled in response to the detected amplitude and frequency of cage 5, and the vibrations of cage 5 caused by the rolling are absorbed and reduced. As a result, cage 5 becomes comfortable to ride in. Further, as damper units 30 do not comprise rubbing parts, there is no friction force generated, and the buffers of adjusting spring 16 are not reduced by the minute vibrations.

Figure 17:
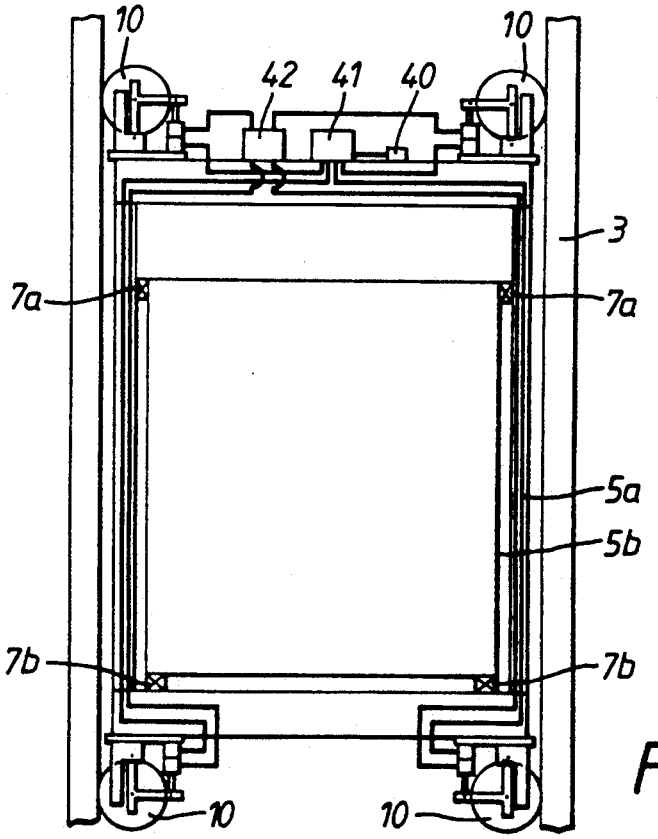
FIG. 17 is a front view illustrating an eighth embodiment of the invention.
Figure 18:
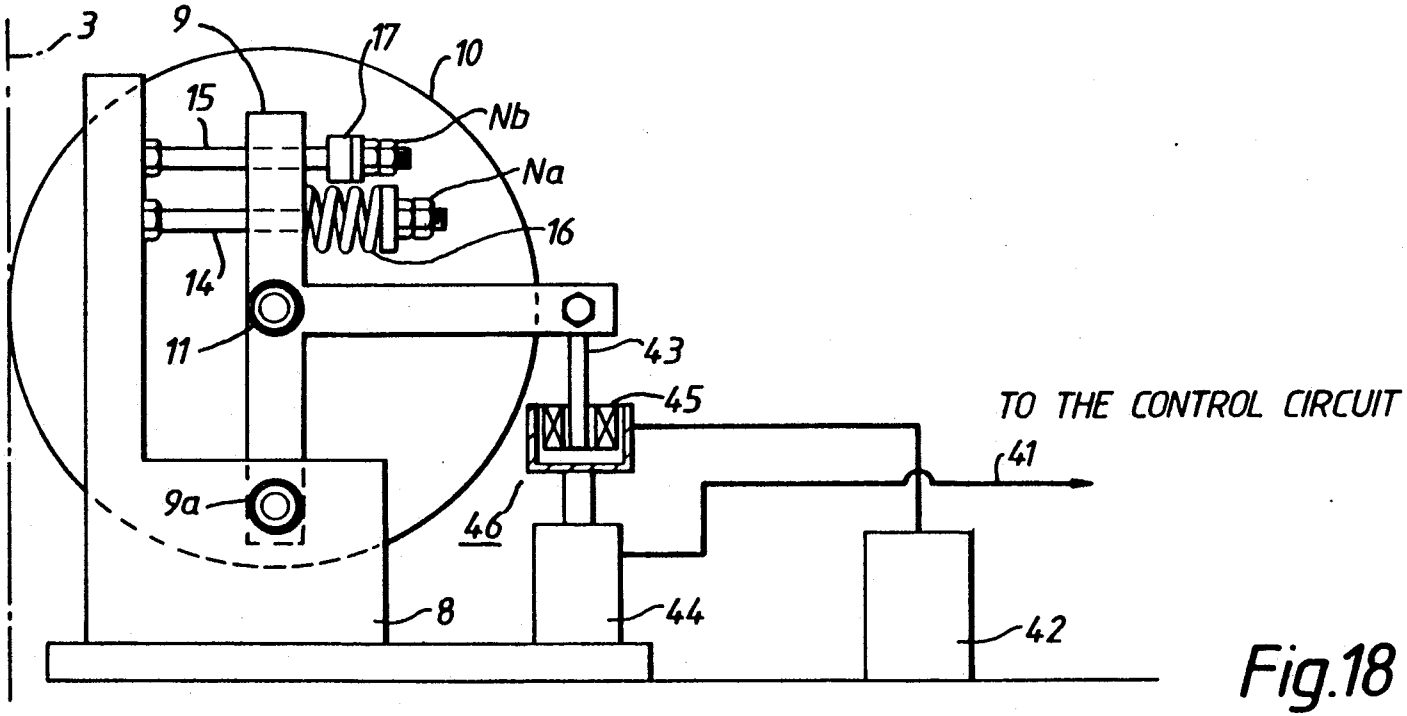
FIG. 18 is an enlarged sectional view illustrating a detailed part of the eighth embodiment of the invention.

An eighth embodiment of the invention will be described in detail with reference to FIGS. 17–21. As shown in FIG. 17, guide rollers 10 are disposed at four corners of cage frame 5*a*, cage frame 5*a* being supported by guide rails 3 through guide rollers 10. Cage room 5*b* is supported by cage frames 5*a* through the vibration-proof materials 7*a*, 7*b*. A vibration sensor 40, (such as an accelerometer) which detects the vibrations of cage 5, a control circuit 41 controlling the modulus of elasticity of guide roller 10 and a resistance circuit 42 are disposed on cage frame 5*a*.

As shown in FIG. 1 8, supporting unit 8 comprises a damper unit 46 consisting of a pole shaped permanent magnet 43 disposed at one end of operating lever 9, a solenoid 44 and a coil 45. Coil 45 is vertically movable along permanent magnet 43 due to solenoid 44. Solenoid 44 is controlled by control circuit 41, and coil 45 is connected to a resistance circuit 42.

Figure 19:
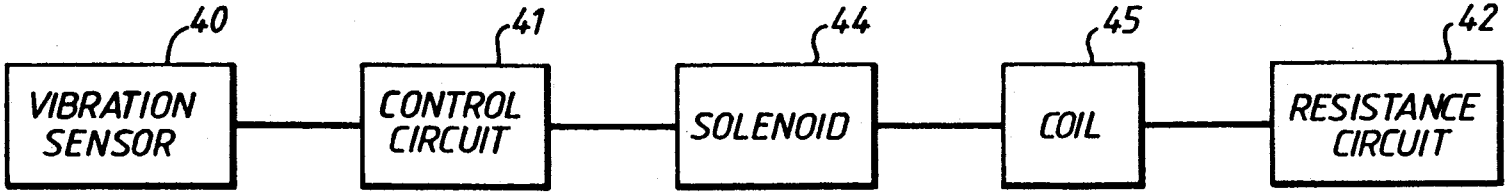
FIG. 19 is a block schematic diagram illustrating the eighth embodiment of the invention.
Figure 20:
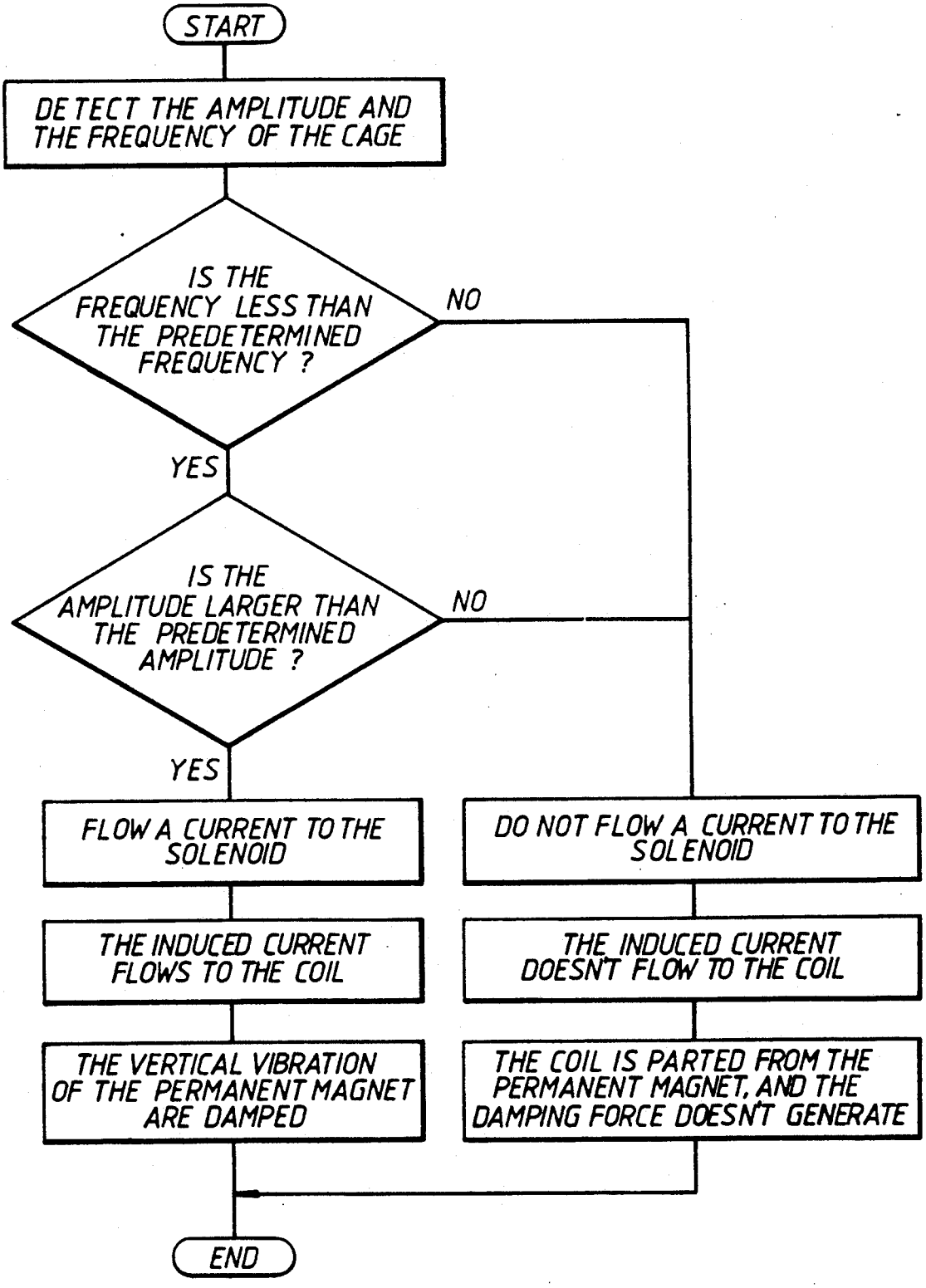
FIG. 20 is a flow chart illustrating the action of the eighth embodiment of the invention.

The operation of this embodiment will be described in greater detail with reference to FIGS. 19 and 20. When cage 5 rises and falls, the amplitude and the frequency of cage 5 are detected by vibration sensor 40. The detected amplitude and frequency then are compared with a predetermined value. As a result, when the detected frequency is smaller than the predetermined frequency (for example, 10 Hz), and the detected amplitude is larger than the predetermined amplitude (for example, 10 gal), control circuit 41 directs the flow of current to solenoid 44. When the current flows to solenoid 44, coil 45 rises along permanent magnet 43, and permanent magnet 43 is suspended in coil 45. In this condition, when operating lever 9 is displaced, permanent magnet 43 is displaced vertically in accordance with the movement of operating lever 9, and an induced current flows in coil 45. As the coil 45 is connected to resistance circuit 42, electricity is converted into heat and the vertical movements of permanent magnet 43 are reduced.

In control circuit 41, when the detected frequency is more than the predetermined frequency (for example, 10 Hz), or the detected amplitude is less than the predetermined amplitude (for example 10 gal), current does not flow to solenoid 44. As a result, coil 45 parts from permanent magnet 43. In this condition, if operating lever 9 is displaced, the induced current flowing in coil 45 is small, and the damping force is reduced. Accordingly, when the frequency is smaller than the predetermined value and the amplitude is larger than the predetermined value, movement of operating lever 9 is damped. When the frequency is more than the predetermined value or the amplitude is less than the predetermined value, movement of operating lever 9 is not as damped due to a reduction or removal of the damping force of damper unit 46. When the amplitude of cage 5 is less than the predetermined value, and the frequency is more than the predetermined value, the damping force of damper unit 46 is greatly decreased.

In this embodiment, when cage 5 rolls in response to the resonance generated by the excitement which is caused by the windings of guide rails 3, the vibrations of cage 5 are controlled. Therefore, the amplitude of the resonance is not increased; rather, the amplitude is decreased as the movement of operating lever 9 is decreased due to an increase of the damping force of damper unit 46.

Minute windings and recesses formed on the guide rails 3 are absorbed by adjusting spring 16, and vibrations do not transmit to cage 5. The damping force of damper unit 46 is controlled in response to the amplitude and the frequency of cage 5 to minimize the vibrations of cage 5. As a result, the occurrence of the rolling of cage 5 is greatly reduced, and elevators made in accordance with the present invention provide a more comfortable ride.

Figure 21:
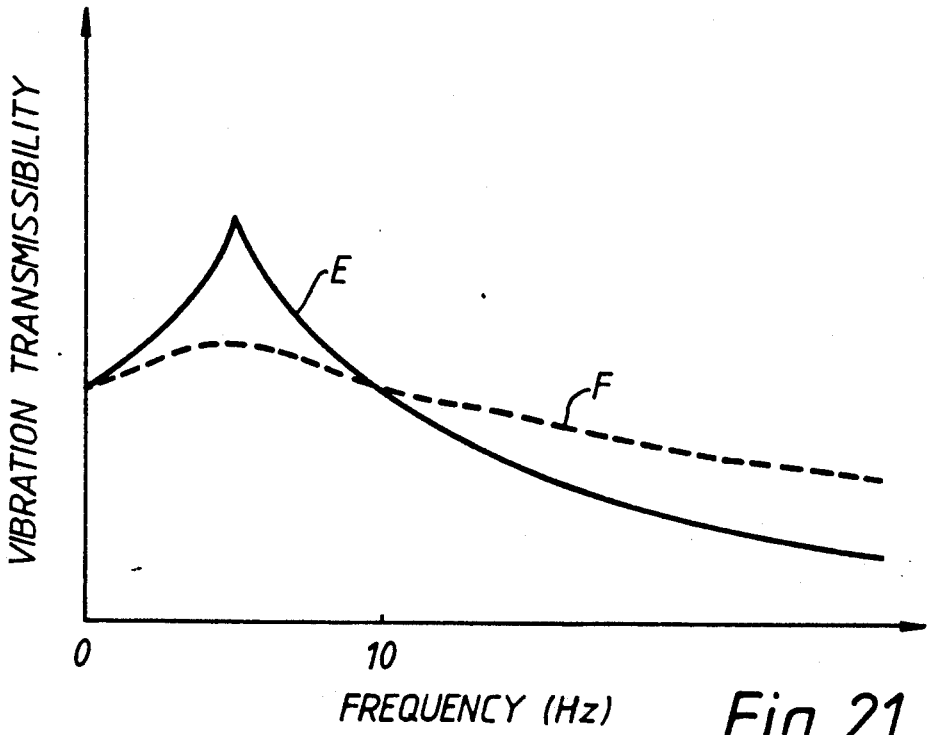
FIG. 21 is a graph illustrating the relationship between the frequency of the cage and the vibration transmissibility of the cage of the eighth embodiment of the invention.

The graph shown in FIG. 21 illustrates the relationship between the frequency of cage 5 and the vibration transmissibility from guide rails 3 to cage 5. In FIG. 21, solid line E indicates a change of the vibrations transmissibility in the case where the damping force is small, and dotted line F indicates a change of the vibration transmissibility in the case where the damping force is large. Accordingly, the vibration transmissibility generated in accordance with the control of the present invention corresponds to the lower of the two lines shown in FIG. 21 at every frequency. Thus, the damping force of damper unit 46 is controlled to minimize the vibration of cage 5 in order to make cage 5 more comfortable.

Figure 22:
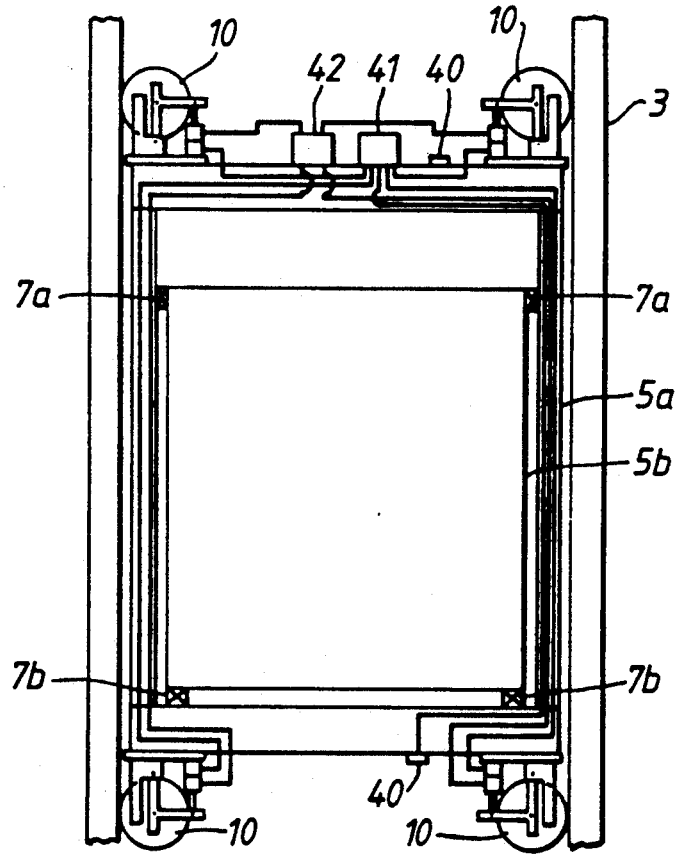
FIG. 22 is a front view illustrating a ninth embodiment of the invention.

In a ninth embodiment, shown in FIG. 22, vibration sensors 40 are disposed at the upper and lower cage frames 5*a* of cage 5. In this embodiment, vibrations generated in each of the upper and lower cage frames 5*a* of cage 5 are detected.

Figure 23:
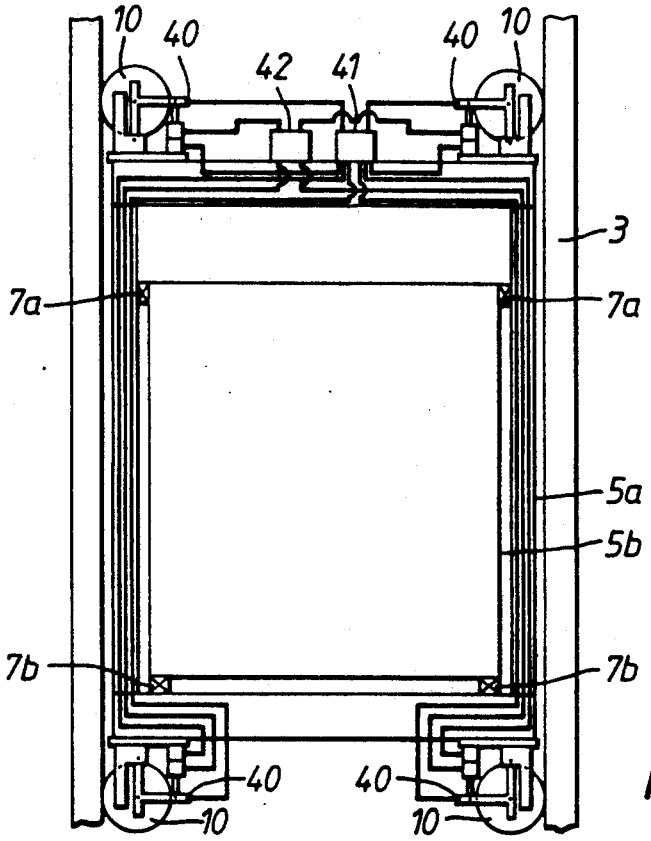
FIG. 23 is a front view illustrating a tenth embodiment of the invention.
Figure 24:
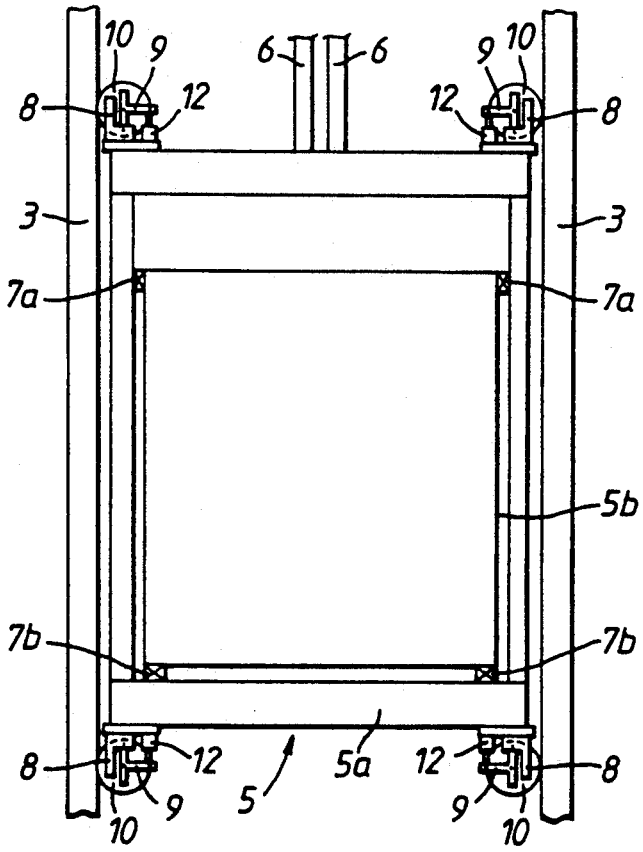
Fig.24 (PRIOR ART)
FIG. 24 is a front view illustrating an elevator of the prior art.
Figure 25:
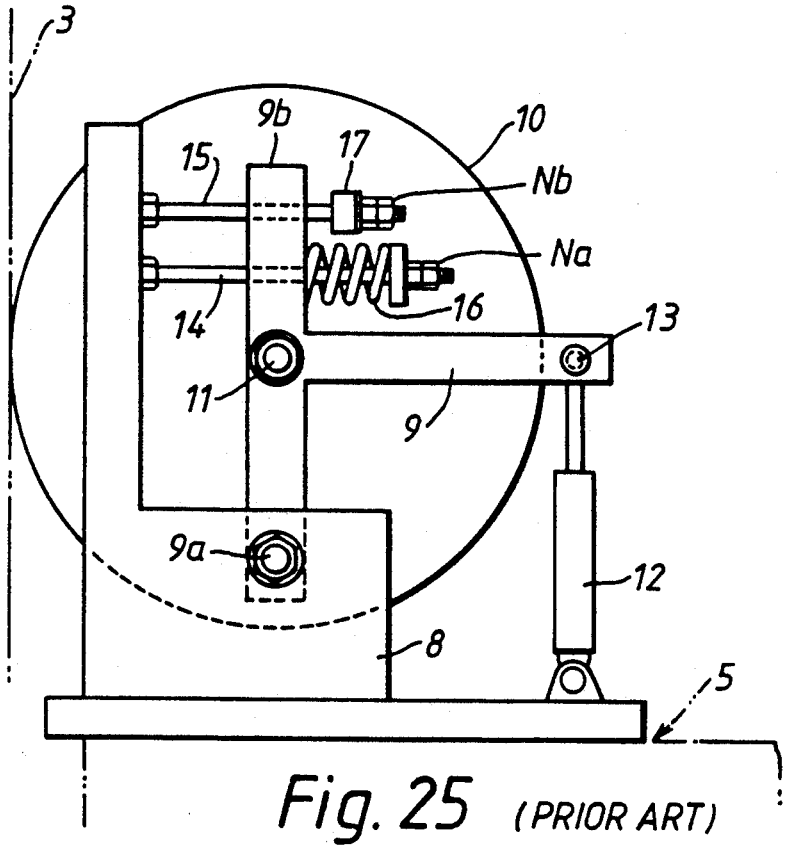
Fig. 25 (PRIOR ART)
FIG. 25 is an enlarged sectional view illustrating an essential part of the elevator of the prior art.
Figure 26:
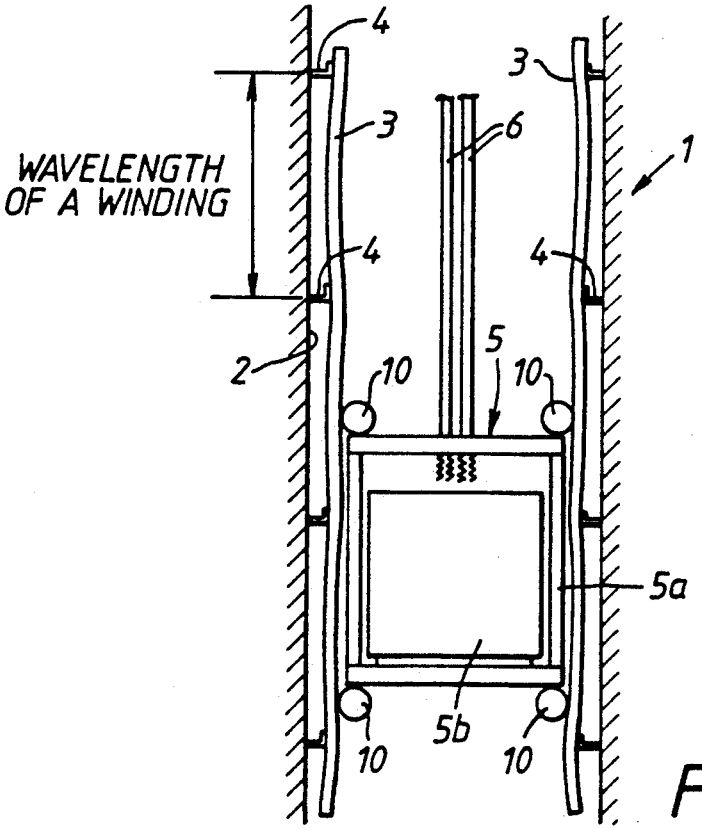
Fig. 26 (PRIOR ART)
FIG. 26 is a front view illustrating an elevator of the prior art.

In a tenth embodiment, shown in FIG. 23, vibration sensors 40 are disposed each at the ends of operating levers 9 and detect the windings of guide rails 3 directly. In this embodiment, the vibrations of cage 5 are detected with greater precision.

As described above in accordance with this invention, as the viscosity of the damper unit is controlled in response to the vibrations of cage 5, cage 5 is more comfortable to ride in.

Although the invention has been described in its preferred form with a certain degree of particularity, it is understood that the present disclosure of the preferred embodiments may be altered in the details of construction, and such alternations of the combination and arrangements of parts may be resorted to without departing from the spirit and the scope of the invention as hereinafter claimed.

What is claimed is:

1. An elevator having a vertically movable cage along guide rails comprising:

supporting units disposed on said cage;

an operating lever pivotally mounted to said supporting units;

guide rollers connected to said supporting units and disposed to touch said guide rails;

damping means operatively connected to said operating level, having a variable coefficient of viscous damping, for damping vibrations of said cage;

detecting means for detecting the vibration of said cage; and control means for controlling the coefficient of viscous damping of said damping means in response to the vibration detected by said detecting means.

2. An elevator as claimed in claim 1, wherein said damping means comprises a cylinder filled with magnetic fluid, and said control means controls the viscosity of the magnetic fluid.

3. An elevator as claimed in claim 1, wherein the control means comprises an electromagnetic coil and a power supply capable of providing a current to the, electromagnetic coil.

4. An elevator as claimed in claim 1, wherein said control means comprises electrodes and a power supply capable of providing a voltage to the electrodes.

5. An elevator as claimed in claim 1, wherein said damping means comprises:

a solenoid;

a cylindrical electromagnetic coil disposed in said solenoid;

a vertically movable orifice lever surrounded by a coil spring; and a plunger movable in said solenoid and having an orifice permitting vertical movement of said orifice lever therein.

6. An elevator as claimed in claim 5, wherein said coil spring further permits the orifice lever to be suspended in said cylindrical electromagnetic coil.

7. An elevator as claimed in claim 5, wherein said vertically movable orifice lever is movable against the action of said coil spring due to the cylindrical electromagnetic coil.

8. An elevator having a vertically movable cage along guide rails comprising:

supporting units disposed on said cage;

an operating lever pivotally mounted to said supporting units;

guide rollers connected to said supporting units and disposed to touch said guide rails;

damping means operatively connected to said operating level having a variable coefficient of viscous damping for damping vibrations of said cage; and control means for controlling the coefficient of viscous damping of said damping means in response to a measured variable.

9. An elevator having a vertically movable cage comprising:

damping means having a variable coefficient of viscous damping, for damping vibrations of said cage, said damping means comprising a cylinder filled with magnetic fluid;

detecting means for detecting the vibration of said cage; and control means for controlling the coefficient of viscous damping of said damping means in response to the vibration detected by said detecting means wherein said control means controls the viscosity of the magnetic fluid.

10. An elevator having a vertically movable cage comprising:

damping means, having a variable coefficient of viscous damping, for damping vibrations of said cage;

detecting means for detecting the vibration of said cage; and control means for controlling the coefficient of viscous damping of said damping means in response to the vibration detected by said detecting means, wherein said control means comprises electrodes and a power supply capable of providing a voltage to the electrodes.

11. An elevator having a vertically movable cage comprising:

damping means, having a variable coefficient of viscous damping, for damping vibrations of said cage, wherein said damping means comprises:

a solenoid;

a cylindrical electromagnetic coil disposed in said solenoid;

a vertically movable orifice lever surrounded by a coil spring; and a plunger movable in said solenoid and having an orifice permitting vertical movement of said orifice lever therein;

detecting means for detecting the vibration of said cage; and control means for controlling the coefficient of viscous damping of said damping means in response to the vibration detected by said detecting means.

12. An elevator as claimed in claim 11, wherein said coil spring further permits the orifice lever to be suspended in said cylindrical electromagnetic coil.

13. An elevator as claimed in claim 11, wherein said vertically movable orifice lever is movable against the action of said coil spring due to the cylindrical electromagnetic coil.

* * * * *